US005863233A

United States Patent [19]

Porter et al.

[11] Patent Number: 5,863,233

[45] Date of Patent: Jan. 26, 1999

[54] FIELD EMITTER FABRICATION USING OPEN CIRCUIT ELECTROCHEMICAL LIFT OFF

[75] Inventors: John D. Porter, Berkeley; Gabriela S. Chakarova, San Jose; N. Johan Knall, Sunnyvale; Christopher J. Spindt, Menlo Park, all of Calif.

[73] Assignee: Candescent Technologies Corporation, San Jose, Calif.

[21] Appl. No.: 848,338

[22] Filed: Apr. 30, 1997

Related U.S. Application Data

[63] Continuation-in-part of Ser. No. 610,729, Mar. 5, 1996, Pat. No. 5,766,446.

[51] Int. Cl.[6] ..... H01J 9/02

[52] U.S. Cl. ..... 445/50; 205/122; 205/640; 205/655; 313/351; 313/495; 156/628; 156/655

[58] Field of Search ..... 205/223, 655, 205/122, 640, 50; 313/351, 495; 156/628, 655; 445/50

[56] References Cited

U.S. PATENT DOCUMENTS

| | | | |
|---|---|---|---|
| 5,129,982 | 7/1992 | Wang et al. | 156/628 |
| 5,578,900 | 11/1996 | Peng et al. | 313/495 |
| 5,650,042 | 7/1997 | Ogura | 156/655 |

*Primary Examiner*—Kathryn Gorgos
*Assistant Examiner*—Thomas Parsons
*Attorney, Agent, or Firm*—Wagner, Murabito & Hao

[57] ABSTRACT

A method for forming a field emitter structure. In one embodiment, the present invention creates a structure having a cavity formed into an insulating layer overlying a first electrically conductive layer. The present invention also creates a second electrically conductive layer with an opening formed above the cavity in the insulating layer. The present embodiment deposits a layer of electron emissive material directly onto the second electrically conductive layer without first depositing an underlying lift-off layer such that the electron emissive material covers the opening in the second electrically conductive layer and forms an electron emissive element within the cavity. The present invention applies a first potential to the first electrically conductive layer, such that the first potential is imparted to the electron emissive element formed within the cavity. The present invention also applies a second potential to the second electrically conductive layer, such that the second potential is imparted to the closure layer of electron emissive material. In the present embodiment, the second potential comprises an open circuit potential. The present invention then exposes the field emitter structure to an electrochemical etchant wherein the electrochemical etchant etches electron emissive material which is biased at the open circuit potential. In so doing, the layer of electron emissive material is removed from above the second electrically conductive layer without etching the electron emissive element formed within the cavity.

23 Claims, 7 Drawing Sheets

FIELD EMITTER FABRICATION USING OPEN CIRCUIT ELECTROCHEMICAL LIFT OFF

This is a Continuation-in-Part of commonly-owned Application entitled "Electrochemical Removal of Material, Particularly Excess Emitter Material in Electron-Emitting Device", Ser. No. 08/610,729, filed Mar. 5, 1996, to Spindt et al. (now U.S. Pat. No. 5,766,446).

TECHNICAL FIELD

The present claimed invention relates to the field of flat panel displays. More specifically, the present claimed invention relates to the deposition and removal of a closure layer in a field emitter structure.

BACKGROUND ART

Field emission cathodes are electron emitting devices which are used, for example, in flat panel displays. A field emission cathode or "field emitter" emits electrons when subjected to an electric field of sufficient strength and appropriate polarity. A side sectional view depicting conventional steps used to manufacture a field emission cathode is shown in Prior Art FIG. 1A. More specifically, in Prior Art FIG. 1A, a first conductive layer or "row electrode" 102 has a resistive layer 104 disposed thereon. An inter-metal dielectric layer 106 disposed above resistive layer 104 has a cavity 108 formed therein. As shown in Prior Art FIG. 1A, a second conductive layer or gate electrode 110 resides above inter-metal dielectric layer 106. A hole or opening 112 is formed through gate electrode 110 directly above cavity 108. Opening 112 is used to form the field emitter which will reside within cavity 108. Typically, the formation of the field emitter is accomplished, in part, using a lift-off or "parting layer", and a closure layer. Unfortunately, conventional lift-off and closure layer deposition and removal methods have severe drawbacks associated therewith.

With reference next to Prior Art FIG. 1B, a side sectional view illustrating the deposition of a lift-off layer 114 is shown. Lift-off layer 114 is formed using an angled physical vapor deposition of, for example, aluminum. Arrows 118 illustrate the angled nature of the deposition of lift-off layer 114. The angled deposition of lift-off layer 114 is required to insure that no lift-off layer material, i.e. aluminum, is deposited into the bottom of cavity 108. As shown in Prior Art FIG. 1B, however, some lift-off layer material 115 may be deleteriously deposited along the sides defining cavity 108. In order to achieve an angled deposition, the entire field emitter structure must be rotated during the deposition of lift-off layer 114. As a result, considerable difficulty, expense, and complexity is introduced into the field emitter structure manufacturing process. Also, lift-off layer 114 must have uniform thickness across the surface of gate electrode 110. This additional requirement of uniformity further complicates the lift-off deposition process.

With reference still to Prior Art FIG. 1B, lift-off layer 114 has another substantial disadvantage associated therewith. Specifically, lift-off layer 114 reduces the opening above cavity 108. That is, lift-off layer 114 attaches to the inner diameter of opening 112 in gate electrode 110. As a result, the diameter of opening 112 is effectively reduced. Hence, the opening above cavity 108 is limited to the diameter of opening 116 in lift-off layer 114. Therefore, the diameter of opening 112 in gate electrode 110 must be increased to insure that the final diameter (i.e. the diameter of opening 116 in lift-off layer 114) is as large as is desired. It is well known, however, that increasing the diameter of opening 112 in gate electrode 110 can reduce the performance characteristics of the field emitter structure.

Referring next to Prior Art FIG. 1C, a side sectional view illustrating the initial formation of a closure layer 118 is shown. Closure layer 118 is comprised of electron emissive material such as, for example, molybdenum. The electron emissive material which forms closure layer 118 is also deposited into cavity 108 as shown by structure 120. Typically, the electron emissive material is deposited using, for example, an e-beam evaporative deposition method.

Referring now to Prior Art FIG. 1D, a side sectional view illustrating a completed deposition of electron emissive material is shown. As shown in Prior Art FIG. 1D, closure layer 118 completely seals cavity 108. Additionally, as the electron emissive material is deposited as shown in Prior Art FIGS. 1C and 1D, an electron emitting structure 120 commonly referred to as a "Spindt-type" emitter is formed within cavity 108 (Spindt-type emitters are described in detail in U.S. Pat. No. 3,665,241 to Spindt et al. which is incorporated herein by reference as background material). After Spindt-type emitter 120 is formed, closure layer 118 must be removed.

With reference now to Prior Art FIG. 1E, a side sectional view illustrating the removal of closure layer 118 is shown. When removing closure layer 118, care must be taken not to damage or otherwise adversely affect Spindt-type emitter 120. Such a removal process is further complicated by the fact that both closure layer 118 and Spindt-type emitter 120 are formed of the same electron emissive material. Prior art techniques remove closure layer 118 by etching lift-off layer 114 using an etchant which attacks the aluminum lift-off layer 114. As a result, lift-off layer 114 "lifts" from underlying gate electrode 110 and, consequently, removes closure layer 118, as illustrated in Prior Art FIG. 1E. Prior art lift-off layer etchants do not, however, attack the electron emissive material of either closure layer 118 or Spindt-type field emitter 120. Unfortunately, such a lift-off process results in the generation of flakes or contaminating chunks, typically shown as 122*a*–122*c*, which contaminate the etchant. Flakes or chunks 122*a*–122*c* can also redeposit within cavity 108, as shown by chunk 122*c*, and compromise the integrity of Spindt-type emitter 120 formed therein. As a result, the Spindt-type emitter can be severely damaged or even shorted to gate electrode 110. Hence, prior art "lift-off" closure layer removal methods include deleterious side effects.

Thus, a need exists for a closure layer deposition and removal method which eliminates the need for a complex and difficult to manufacture lift-off layer. A further need exists for a closure layer deposition and removal method which does not substantially limit gate electrode hole diameter. Yet another need exists for a closure layer deposition and removal method which reduces deleterious redeposition of portions of the closure layer within the emitter cavity.

DISCLOSURE OF THE INVENTION

The present invention provides a closure layer deposition and removal method which eliminates the need for a complex and difficult to manufacture lift-off layer; a closure layer deposition and removal method which does not substantially limit gate electrode hole diameter; and a closure layer deposition and removal method which reduces deleterious redeposition of portions of the closure layer within the emitter cavity.

Specifically, in one embodiment, the present invention creates a structure having a cavity formed into an insulating layer overlying a first electrically conductive layer. The present invention also creates a second electrically conductive layer with an opening formed above the cavity in the insulating layer. The present embodiment deposits a layer of electron emissive material directly onto the second electrically conductive layer without first depositing an underlying lift-off layer. In so doing, the electron emissive material covers the opening in the second electrically conductive layer and forms an electron emissive element within the cavity. The present invention applies a first bias potential to the first electrically conductive layer, such that the first bias potential is imparted to the electron emissive element formed within the cavity. The present invention also applies a second bias potential to the second electrically conductive layer, such that the second bias potential is imparted to the layer of electron emissive material. In the present embodiment, the second bias potential comprises the open circuit potential. The present invention then exposes the field emitter structure to an electrochemical etchant wherein the electrochemical etchant etches electron emissive material at open circuit potential. In so doing, by appropriate choice of the first bias potential, the layer of electron emissive material is removed from above the second electrically conductive layer without substantially etching the electron emissive element formed within the cavity.

Hence, the present invention eliminates the need to deposit a lift-off layer before depositing the overlying closure layer. As such, the complex manufacturing requirements, and numerous defects associated with the use of a conventional lift-off layer are eliminated by the present invention.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

Prior Art

Prior Art

Prior Art

Prior Art

Prior Art

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1A:
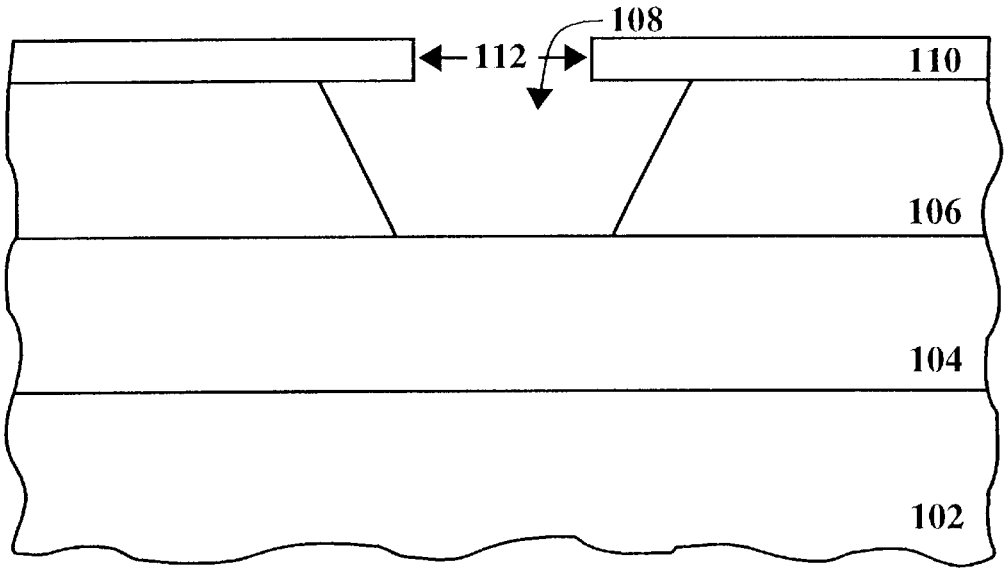
FIG. 1A (Prior Art)
FIG. 1A is a side sectional view of a field emitter structure prior to the deposition of a lift-off layer.
Figure 1B:
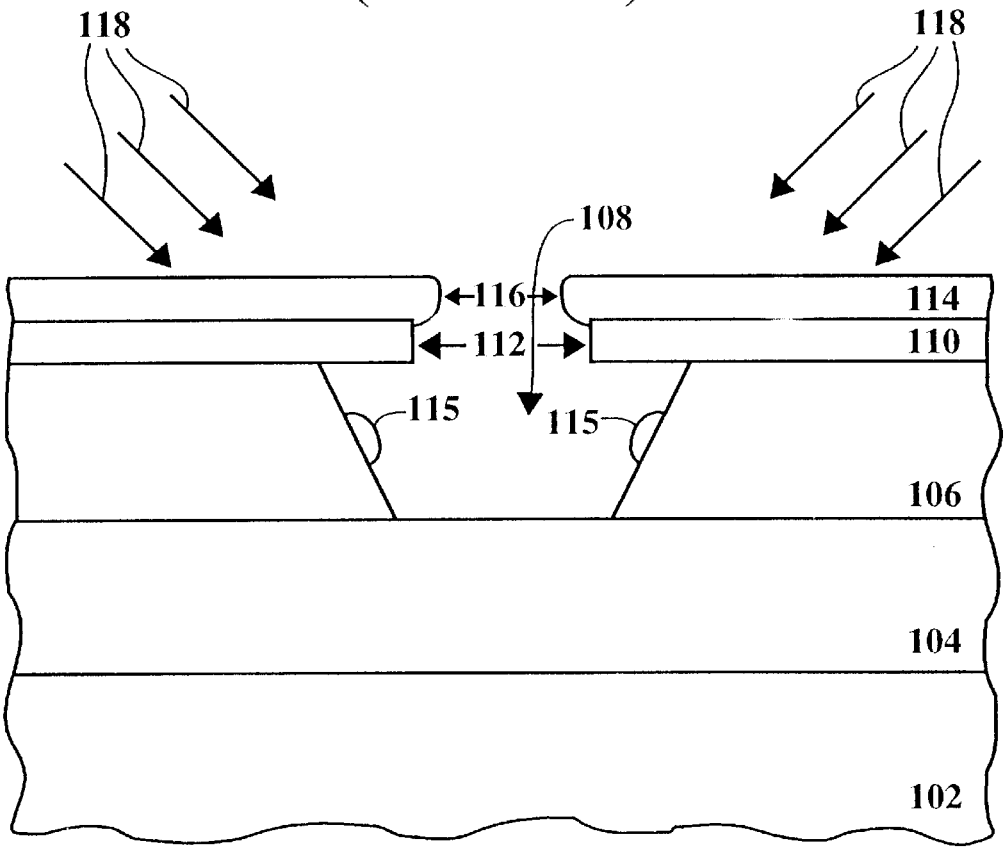
FIG. 1B (Prior Art)
FIG. 1B is a side sectional view illustrating the deposition of a lift-off layer.
Figure 1C:
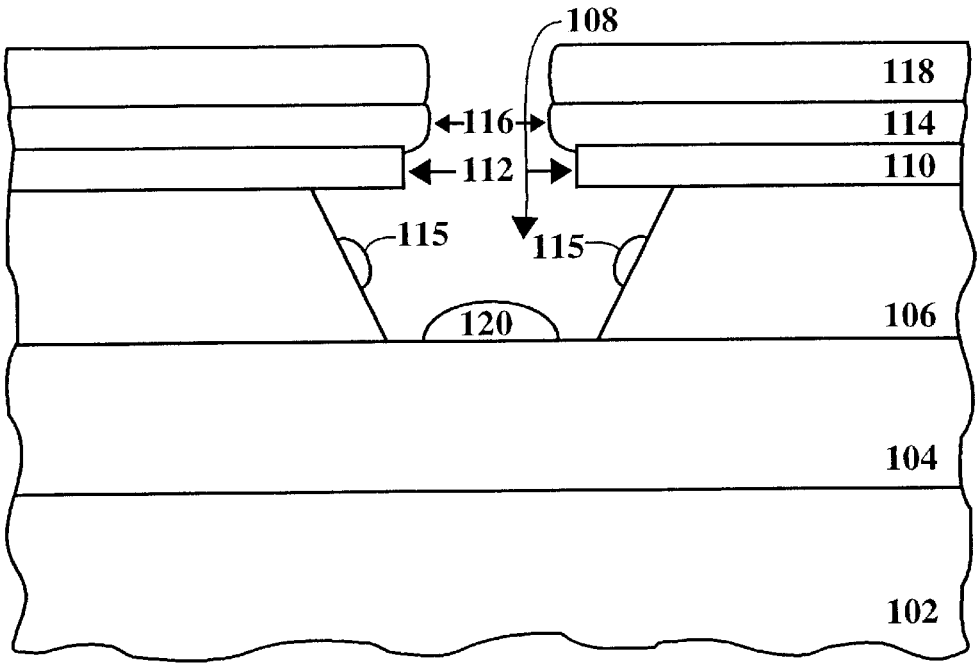
FIG. 1C (Prior Art)
FIG. 1C is a side sectional view illustrating the initial formation of a closure layer.
Figure 1D:
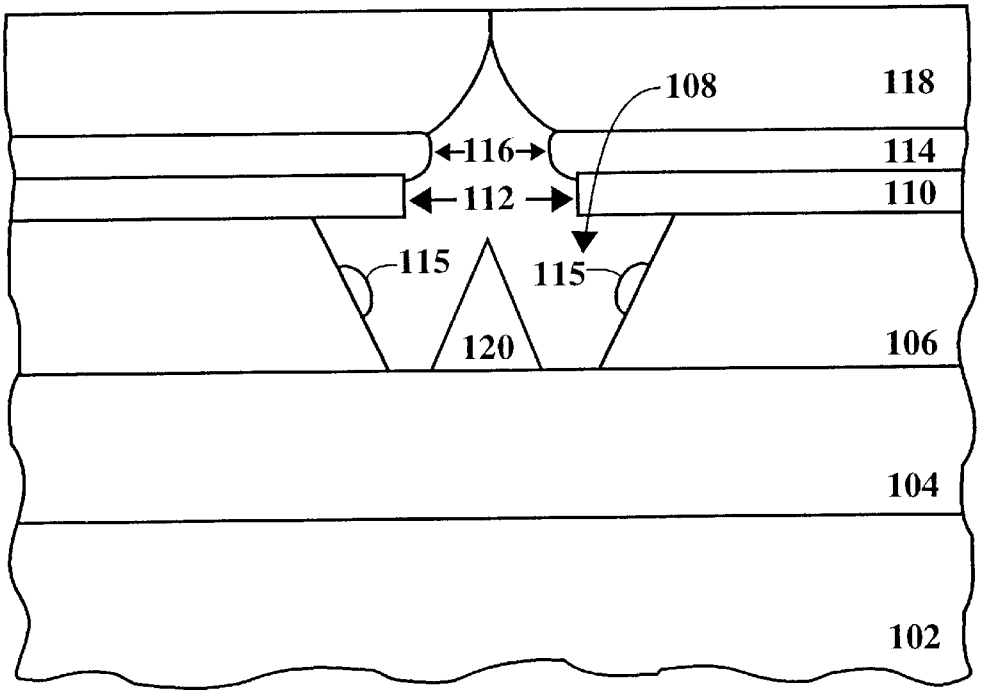
FIG. 1D (Prior Art)
FIG. 1D is a side sectional view illustrating a completed deposition of electron emissive material.
Figure 1E:
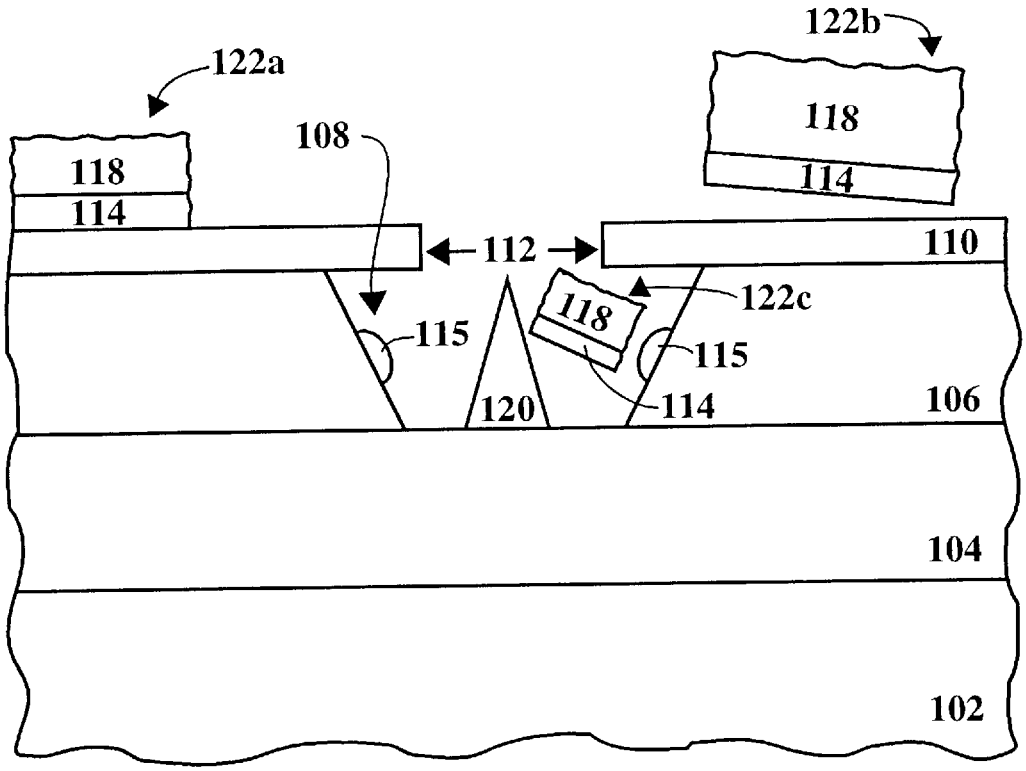
FIG. 1E (Prior Art)
FIG. 1E is a side sectional view illustrating a lift-off removal process.
Figure 2A:
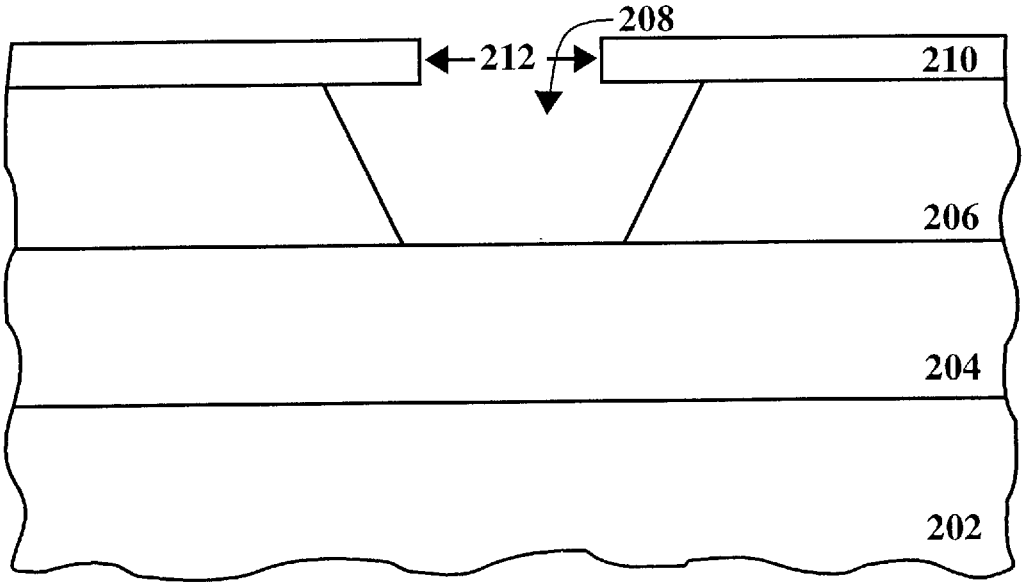
FIG. 2A is a side sectional view depicting initial formation steps used to manufacture a field emitter structure in accordance with the present claimed invention.

Referring now to FIG. 2A, a side sectional view depicting initial formation steps used to manufacture a field emitter structure in accordance with the present claimed invention is shown. As shown in FIG. 2A, a first conductive layer or row electrode 202 has a resistive layer 204 disposed thereon. (The present invention is, however, also well suited to various other configurations in which, for example, the first conductive layer resides under only portions of the resistive layer.) An intermetal dielectric layer 206, comprised, for example, of silicon dioxide, is disposed above resistive layer 204. A cavity 208 is formed within inter-metal dielectric layer 206. A second conductive layer or gate electrode 210 resides above inter-metal dielectric layer 206. A hole or opening 212 is formed through gate electrode 210 directly above cavity 208. Opening 212 is used to form the field emitter which will reside within cavity 208.

Figure 2B:
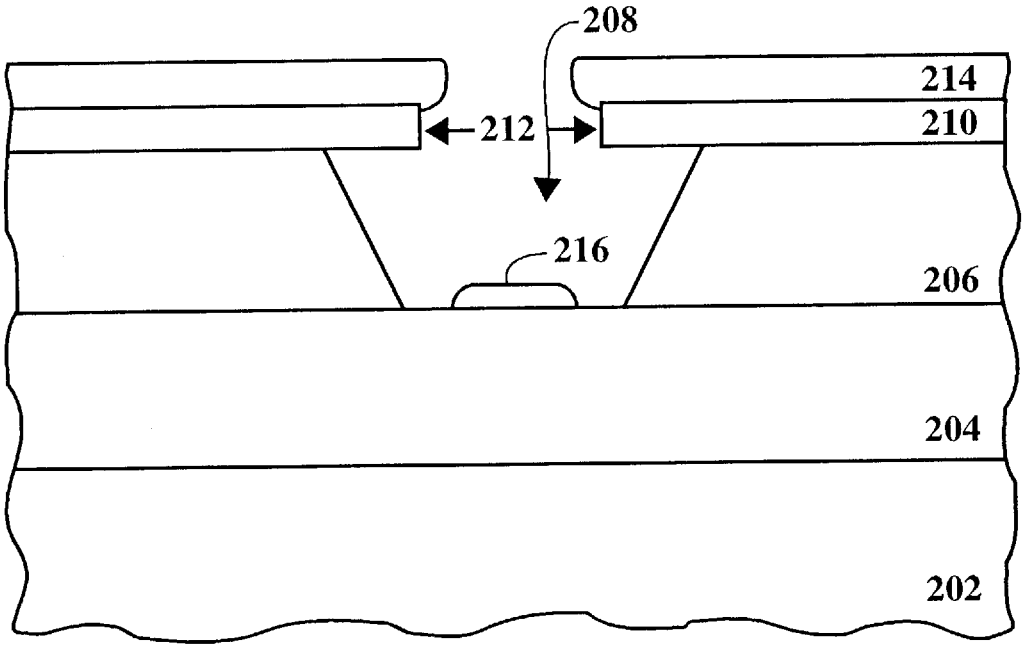
FIG. 2B is a side sectional view depicting an initial deposition of electron emissive material directly onto a gate electrode in accordance with the present claimed invention.

Referring now to FIG. 2B, a side sectional view depicting an initial deposition of electron emissive material onto a field emitter structure in accordance with the present claimed invention is shown. As shown in FIG. 2B, the electron emissive material is deposited directly onto gate electrode 210 to form a closure layer 214. Thus, the present invention does not require an underlying lift-off layer. As a result, the present invention eliminates the expensive, time-consuming, and complex manufacturing steps associated with the formation of a conventional lift-off layer. Additionally, closure layer 214 of the present invention is not bound by the precise uniformity requirements of a conventional lift-off layer. Therefore, closure layer 214 of the present invention can be deposited without the process constraints associated with the deposition of a lift-off layer.

In the present embodiment, the electron emissive material of closure layer 214 is comprised of molybdenum which is deposited using a physical vapor deposition method such as, for example, an electron beam (e-beam) evaporative technique. Although molybdenum is used as the electron emissive material in the present embodiment, the present invention is also well suited to the use of various other electron emissive materials deposited using various other deposition techniques.

Referring still to FIG. 2B, the electron emissive material deposited directly onto gate electrode 210 is also deposited into cavity 208 as shown by structure 216. Unlike prior art methods, the diameter of structure 216 is not compromised by an effective reduction of the diameter of opening 212 in gate electrode 210. That is, the diameter of opening 212 in gate electrode 210 is not reduced by the accumulation of lift-off layer material around the inner diameter thereof. Therefore, unlike prior art methods, the diameter of opening 212 in gate electrode 210 does not need to be increased to insure that the diameter at the start of emitter deposition is as large as desired. As a result, the performance characteristics of the field emitter structure of the present invention are not reduced by having to increase the diameter of opening 212 in gate electrode 210.

Figure 2C:
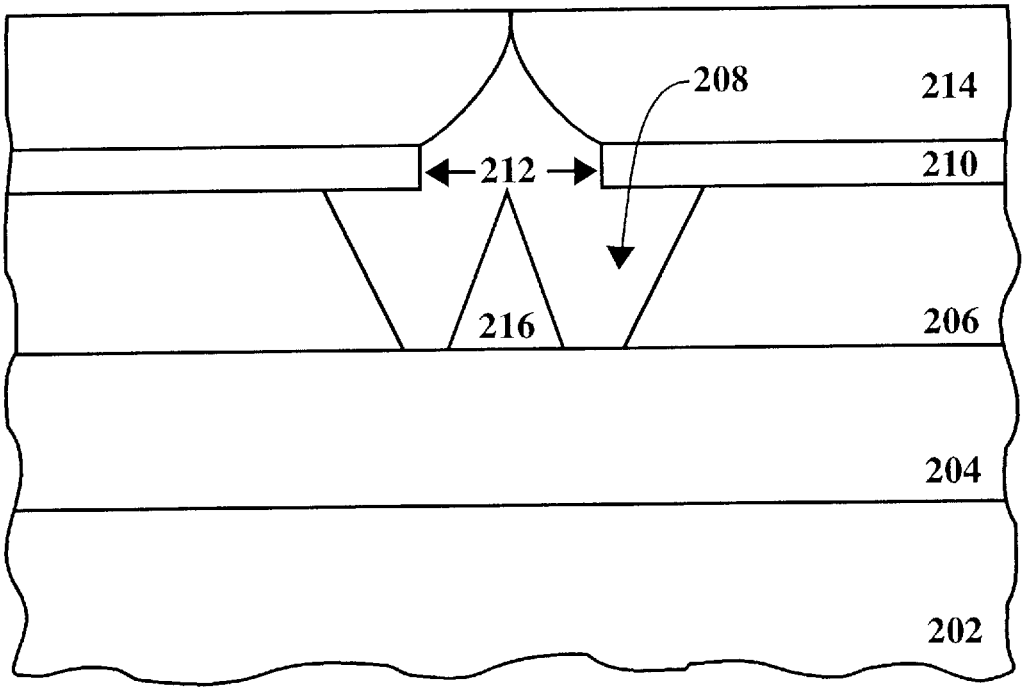
FIG. 2C is a side sectional view illustrating a completed closure layer and an electron emissive element in accordance with the present claimed invention.

With reference next to FIG. 2C, a side sectional view illustrating a completed closure layer and an electron emissive element in accordance with the present claimed invention is shown. As shown in FIG. 2C, closure layer 214, formed directly on gate electrode 210, completely seals cavity 208. Furthermore, as the electron emissive material is deposited onto gate electrode 210 and through opening 212, a Spindt-type emitter 216 is formed within cavity 208. Unlike prior art field emitter structures, in the present invention, the size and height of Spindt-type emitter 216 is not adversely affected by a restricted or narrowed opening in the layers above cavity 208. As a result, the present invention allows for a decreased ratio of opening diameter 212 to inter-metal dielectric thickness while keeping the tip of Spindt-type emitter 216 near gate electrode 210.

Figure 2D:
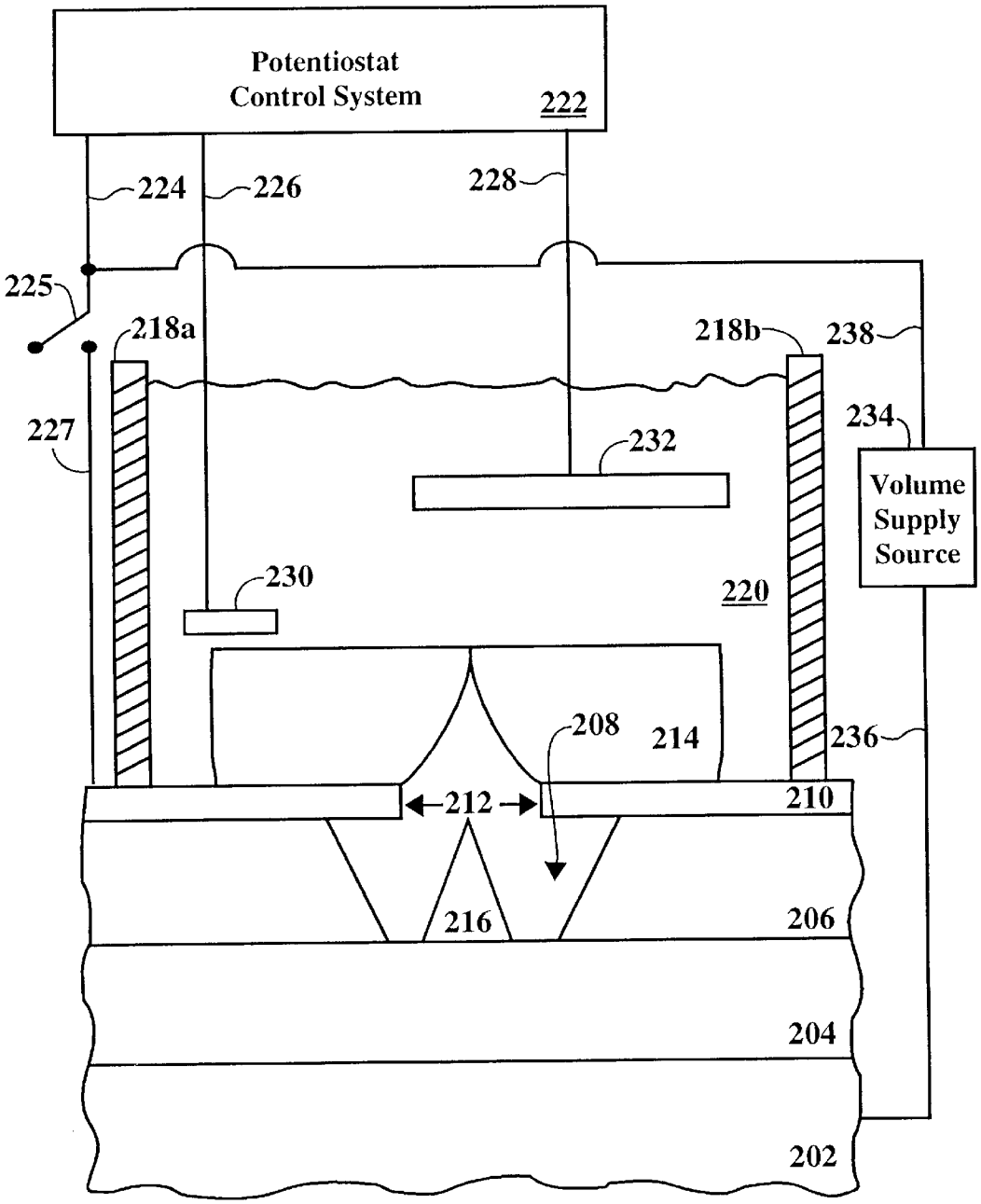
FIG. 2D is a side sectional schematic view of a field emitter structure in an electrochemical cell in accordance with the present claimed invention.

Referring now to FIG. 2D, a side sectional schematic view of a field emitter structure in an electrochemical cell in accordance with the present claimed invention is shown. In order to expose Spindt-type emitter 216, closure layer 214 must be removed from the surface of gate electrode 210. In the present embodiment, an electrochemical cell is used to remove closure layer 214 from the surface of gate electrode 210. As shown in FIG. 2D, walls, typically shown as 218*a* and 218*b*, enclose an electrolytic solution 220 which can function as an electrochemical etchant. The field emitter structure is immersed or otherwise subjected to the electrochemical etchant 220. The present invention is well suited to the use of various types of electrochemical etchants.

Referring still to FIG. 2D, a potentiostat control system 222 has electrode conductors 224, 226, and 228 extending therefrom. Electrode conductor 224 is coupled to gate electrode 210 through switch 225 and electrode conductor 227. Electrode conductor 226 is coupled to reference electrode 230. Similarly, electrode conductor 228 is coupled to counter electrode 232. Electrode conductor 224 is also coupled to voltage supply source 234 by electrode conductor 238. Another electrode conductor 236 is coupled between voltage supply source 234 and row electrode 202. By employing voltage supply source 234, the present invention is able to maintain a. potential difference between gate electrode 210 and row electrode 202 when desired. In the present embodiment, reference electrode 230 is formed of materials such as, for example, silver/silver chloride/aqueous potassium chloride, which readily exchanges ions with the electrochemical etchant at a rate which is not substantially dependent on the amount of current flowing through the electrochemical etchant.

It can be seen from FIG. 2D, that Spindt-type emitter 216 is electrically coupled to row electrode 202 via resistive layer 204. Similarly, closure layer 214 is electrically coupled to gate electrode 210. In accordance with the present invention, gate electrode 210 is at a potential equal to open circuit potential. As a result of being electrically coupled to gate electrode 210, closure layer 214 is also at open circuit potential. On the other hand, a protective bias is applied to row electrode 202. As a result of being electrically coupled to row electrode 202, Spindt-type emitter 216 also has the protective bias applied thereto.

In the present invention, the electrochemical etchant etches the closure layer when the closure layer is at open circuit potential. Thus, in one embodiment, switch 225 is closed and gate electrode 210 and closure layer 214 are held at open circuit potential by potentiostat control system 222, while electrode 202 is held at a potential negative with respect to open circuit potential. As a result, the open circuit potential is imparted to closure layer 214, while a protective substantially "non-etching" potential is imparted to Spindt-type emitter 216. Therefore, the electrochemical etchant etches closure layer 214 without substantially affecting Spindt-type emitter 216.

In another embodiment of the present invention, switch 225 is open and gate electrode 210 and closure layer 214 remain at open circuit potential without electrode biasing, while electrode 202 is held at a potential negative with respect to open circuit potential. Again, the electrochemical etchant etches closure layer 214 (which remains at open circuit potential) without affecting Spindt-type emitter 216. In an embodiment where gate electrode 210 is at open circuit potential without electrode biasing, the value of the open circuit potential of gate electrode 210 measured with respect to reference electrode 230 is used to determine the endpoint of the closure layer removal process.

Moreover, because the present invention etches at open circuit potential, the electrochemical etchant is not contaminated by chunks or flakes of closure layer 214. That is, if a chunk or flake of closure layer 214 separates from gate electrode 210 into solution 220, the chunk will remain at open circuit potential. Therefore, the chunk of closure layer material dissolves instead of contaminating the electrochemical etchant or filters thereof. Additionally, by dissolving any chunks or flakes of closure layer material, the present invention reduces the chance of having a chunk or flake of closure layer 214 re-deposit into cavity 208. Consequently, the present invention dissolves closure layer 214 instead of employing the lift-off process of the prior art. As a result, closure layer 214 is completely removed, as shown in FIG. 2E, without contaminating cavity 208 or the bath of electrochemical etchant 220 of FIG. 2D.

Figure 2E:
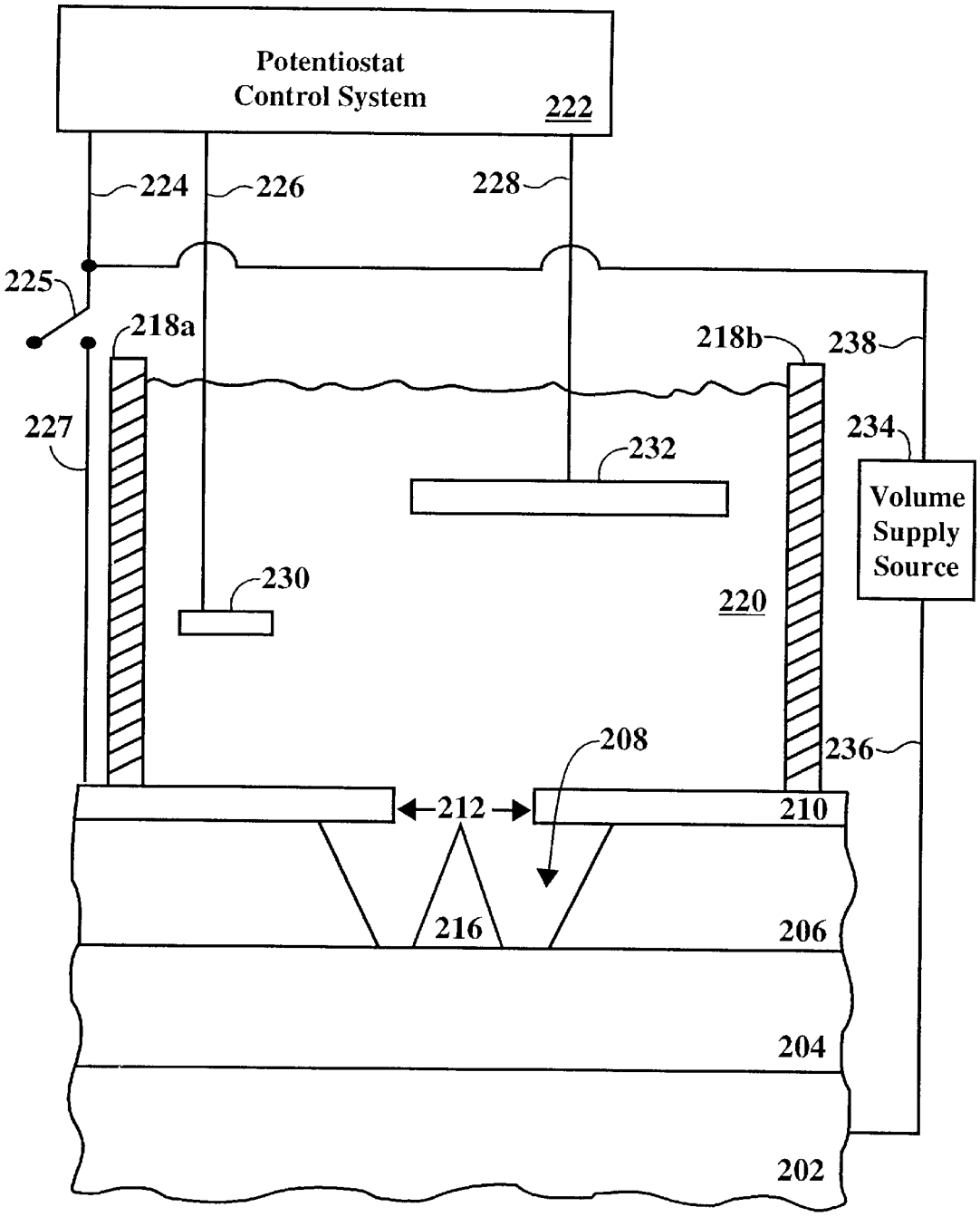
FIG. 2E is a side sectional view of a field emitter structure having electrodes coupled thereto and having a closure layer removed therefrom in accordance with the present claimed invention.

With reference now to FIG. 2E, the field emitter structure is shown after closure layer 214 is substantially and adequately removed from gate electrode 210. Next, the entire field emitter structure will be removed from electrochemical etchant 220 of FIG. 2D. Because some electrochemical etchant 220 may remain on the field emitter structure, in this embodiment of the present invention, voltage supply source 234 continues to apply the protective non-etching potential to row electrode 202 via electrode conductor 236. The protective non-etching potential is maintained until the electrochemical etchant is substantially removed (e.g. by a rinse process) from the field emitter structure. In so doing, the present invention prevents unwanted etching of Spindt-type emitter 216 from occurring from the time the field emitter structure is removed from electrochemical etchant 220 until the field emitter structure is rinsed clean.

With reference again to FIG. 2D, in the present embodiment the protective non-etching potential imparted to row electrode 202 via electrode conductor 236 is on the order of hundreds of millivolts. The total etching time is on the order of approximately 5–30 minutes. Although such a voltage potential and etch time is used in the present embodiment, the present invention is also well suited to the use of various other voltage potentials and etch times.

In yet another embodiment, the potential applied to row electrode 202 is altered such that both closure layer 214 and Spindt-type emitter 216 are etched concurrently. That is, Spindt-type emitter 216 is also etched (although at a much lower rate than the rate at which closure layer 214 is etched). In so doing, the present embodiment helps to eliminate or etch away chunks or pieces of closure layer material 214 which may deleteriously couple a Spindt-type emitter to the overlying gate electrode. In such an embodiment, the etch rate of Spindt-type emitter 216 will increase as the potential applied to row electrode 202 approaches open circuit potential. Furthermore, it will be understood that the etch rate of Spindt-type emitter 216 with respect to closure layer 214 can be varied by adjusting the impedance provided by resistive layer 204.

As yet another advantage, the present invention is able to etch closure layer 214 even if an oxide layer or other obstruction is present between gate electrode 210 and closure layer 214. That is, closure layer 214 will be at an open circuit potential even if electrically insulated from gate electrode 210.

Thus, the present invention provides a closure layer deposition and removal method which eliminates the need for a complex and difficult to manufacture lift-off layer; a closure layer deposition and removal method which does not substantially limit gate electrode hole diameter; and a closure layer deposition and removal method which reduces deleterious redeposition of portions of the closure layer within the emitter cavity.

The present invention is also well suited for multi-layer emitters where the emitter and closure layer consist of a first and a second layer. It is possible to accomplish removal of the closure layer by only etching of the first layer in a manner described in the above embodiment. This method retains the benefits of removing the requirement for an angled evaporated parting layer and will not limit the hole diameter. The first layer is chosen for its etch properties and the second layer for its emission properties. One such combination of layers is molybdenum over nickel.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

We claim:

1. In a field emitter structure having a cavity formed into an insulating layer overlying at least a portion of a first electrically conductive layer, and a second electrically conductive layer having an opening formed above said cavity, a method for applying and removing a closure layer, said method comprising the steps of:

a) depositing a layer of electron emissive material over said second electrically conductive layer such that said electron emissive material covers said opening in said second electrically conductive layer and forms an electron emissive element within said cavity, said layer of electron emissive material deposited directly onto said second electrically conductive layer without first depositing an underlying lift-off layer;

b) applying a potential to said first electrically conductive layer;

c) having said second electrically conductive layer at open circuit potential such that said open circuit potential is imparted to said layer of electron emissive material; and d) exposing said field emitter structure to an electrochemical etchant such that said layer of electron emissive material is removed from said field emitter structure.

2. The method as recited in claim 1 wherein step c) further comprises the step of c1) applying a second potential to said second electrically conductive layer, said second potential close in value to said open circuit potential.

3. The method as recited in claim 1 wherein said second electrically conductive layer remains at open circuit potential without having a second potential applied thereto.

4. The method as recited in claim 3 further including the step of:

e) determining the endpoint of the electron emissive etching process of step d) using a reference electrode.

5. The method as recited in claim 1 wherein step a) further comprises depositing said electron emissive layer over said second electrically conductive layer by physical vapor deposition directly onto said second electrically conductive layer.

6. The method as recited in claim 1 wherein step b) further comprises applying said potential to said first electrically conductive layer such that said potential is imparted to said electron emissive element formed within said cavity.

7. The method as recited in claim 1 wherein step d) further comprises exposing said field emitter structure to said electrochemical etchant wherein said electrochemical etchant etches said electron emissive material when said electron emissive material is at said open circuit potential such that said layer of electron emissive material is removed from said field emitter structure without etching said electron emissive element formed within said cavity.

8. The method as recited in claim 1 further including the step of:

e) continually applying said potential to said first electrically conductive layer and continually holding said second electrically conductive layer at said open circuit potential as said field emitter structure is removed from said electrochemical etchant and until said electrochemical etchant is substantially removed from said field emitter structure.

9. The method as recited in claim 1 wherein step a) further comprises depositing two layers of different composition onto said second electrically conductive layer such a multilayer emitter structure is formed.

10. A method for selectively etching a closure layer of a field emitter structure without etching an electron emissive element of said field emitter structure, said method comprising the steps of:

a) applying a potential to a first electrically conductive layer at least partially underlying an insulating layer having a cavity formed therein;

b) having an open circuit potential at a second electrically conductive layer overlying said insulating layer, said second electrically conductive layer having an opening formed therethrough, said opening disposed above said cavity in said insulating layer; and c) exposing said field emitter structure to an electrochemical etchant such that said closure layer formed of electron emissive material disposed above said second electrically conductive layer is removed from said field emitter structure without substantially etching said electron emissive element disposed within said cavity, said electron emissive element also formed of said electron emissive material, said closure layer of said electron emissive material removed from said second electrically conductive layer without requiring an underlying lift-off layer.

11. The selective etching method as recited in claim 10 wherein step b) further comprises the step of b1) applying a second potential to said second electrically conductive layer, said second potential equal in value to said open circuit potential.

12. The selective etching method as recited in claim 10 wherein said second electrically conductive layer remains at open circuit potential without having a second potential applied thereto.

13. The selective etching method as recited in claim 10 wherein step a) further comprises applying said potential to said first electrically conductive layer such that said potential is imparted to said electron emissive element disposed within said cavity.

14. The selective etching method as recited in claim 10 wherein step b) further comprises having said second electrically conductive layer at said open circuit potential such that said open circuit potential is imparted to said closure layer of said electron emissive material.

15. The selective etching method as recited in claim 10 wherein step c) further comprises exposing said field emitter structure to said electrochemical etchant wherein said electrochemical etchant etches said electron emissive material when said electron emissive material is biased at said open circuit potential.

16. The selective etching method as recited in claim 10 further including the step of:

d) determining the endpoint of the electron emissive material removal process of step c) using a reference electrode.

17. The selective etching method as recited in claim 10 further including the step of:

e) continually applying said potential to said first electrically conductive layer and continually having said second electrically conductive layer at said open circuit potential as said field emitter structure is removed from said electrochemical etchant and until said electrochemical etchant is substantially removed from said field emitter structure.

18. A method for forming a field emitter structure comprising the steps of:

a) creating a structure having a cavity formed into an insulating layer overlying a first electrically conductive layer, and a second electrically conductive layer having an opening formed above said cavity;

b) depositing a layer of electron emissive material directly onto said second electrically conductive layer without first depositing an underlying lift-off layer such that said electron emissive material covers said opening in said second electrically conductive layer and forms an electron emissive element within said cavity;

c) applying a first potential to said first electrically conductive layer, such that said first potential is imparted to said electron emissive element formed within said cavity;

d) having said second electrically conductive layer at an open circuit potential such that said open circuit potential is imparted to said layer of electron emissive material; and e) exposing said field emitter structure to an electrochemical etchant wherein said electrochemical etchant etches said electron emissive material when said electron emissive material is biased at said open circuit potential such that said layer of electron emissive material is removed from said field emitter structure without substantially etching said electron emissive element formed within said cavity.

19. The field emitter structure forming method as recited in claim 18 wherein step a) further comprises depositing said electron emissive layer over said second electrically conductive layer by physical vapor deposition directly onto second electrically conductive layer.

20. The field emitter structure forming method as recited in claim 18 wherein step d) further comprises the step of:

d1) applying a second potential to said second electrically conductive layer, said second potential equal in value to said open circuit potential.

21. The field emitter structure forming method as recited in claim 18 wherein said second electrically conductive layer remains at open circuit potential without having a second potential applied thereto.

22. The field emitter structure forming method as recited in claim 18 further including the step of:

f) determining the endpoint of the electron emissive material removal process of step e) using a reference electrode.

23. The field emitter structure forming method as recited in claim 18 further including the step of:

f) continually applying said first potential to said first electrically conductive layer and continually having said second electrically conductive layer at said open circuit potential as said field emitter structure is removed from said electrochemical etchant and until said electrochemical etchant is substantially removed from said field emitter structure.

* * * * *